US008615853B2

(12) United States Patent
Rathbun

(10) Patent No.: US 8,615,853 B2
(45) Date of Patent: Dec. 31, 2013

(54) MULTIPOLE MAGNET FOR HOLDING ITEMS TO CLOTHING

(76) Inventor: Donald P Rathbun, San Antonio, TX (US)

( * ) Notice: Subject to any disclaimer, the term of this patent is extended or adjusted under 35 U.S.C. 154(b) by 630 days.

(21) Appl. No.: 12/925,039

(22) Filed: Oct. 12, 2010

(65) Prior Publication Data

US 2012/0086530 A1 Apr. 12, 2012

(51) Int. Cl.
*A45F 5/02* (2006.01)
*H01F 7/02* (2006.01)

(52) U.S. Cl.
USPC ..... 24/303; 24/3.1

(58) Field of Classification Search
USPC ..... 24/303, 3.1; 335/302, 303, 306
See application file for complete search history.

(56) References Cited

U.S. PATENT DOCUMENTS

| | | | | |
|---|---|---|---|---|
| 2,397,931 | A | 4/1946 | Ellis | |
| 2,592,395 | A | 4/1952 | Cummings | |
| 2,601,424 | A | 6/1952 | Baker | |
| 2,659,169 | A | 11/1953 | Brennan | |
| 2,663,060 | A | 12/1953 | Harrow | |
| 2,693,654 | A | 11/1954 | Clark | |
| 2,935,662 | A | 5/1960 | Hausmann | |
| 3,141,216 | A | 7/1964 | Brett | |
| 3,416,195 | A | 12/1968 | Borthwick | |
| 4,081,114 | A | 3/1978 | Inoue | |
| 5,369,899 | A * | 12/1994 | Reeves | 24/303 |
| 5,682,648 | A | 11/1997 | Miller | |
| 6,175,963 | B1 | 1/2001 | Loeffelholz | |
| 6,260,749 | B1 | 7/2001 | Horovitz | |
| 6,282,760 | B1 | 9/2001 | Mars | |
| 6,367,126 | B1 | 4/2002 | Rivkin | |
| 6,446,372 | B1 * | 9/2002 | Reeves | 24/303 |
| 6,971,147 | B2 * | 12/2005 | Halstead | 24/303 |
| 6,981,391 | B2 * | 1/2006 | Suzuki | 24/303 |
| 7,120,972 | B2 | 10/2006 | O' Banion | |
| 7,921,524 | B2 * | 4/2011 | Maurer | 24/303 |
| 2005/0097711 | A1 * | 5/2005 | Halstead | 24/303 |
| 2005/0144760 | A1 * | 7/2005 | Verbaas et al. | 24/3.1 |
| 2006/0096070 | A1 * | 5/2006 | Ishida | 24/303 |
| 2009/0083951 | A1 * | 4/2009 | Maurer | 24/303 |
| 2010/0122438 | A1 * | 5/2010 | Amron | 24/303 |

* cited by examiner

*Primary Examiner* — Robert J Sandy

(57) ABSTRACT

In a magnetic holding device for attaching items such as eyeglasses, a badge, identification, jewelry, or accessories to an article of clothing, the magnet is replaced with a multipole magnet.

4 Claims, 3 Drawing Sheets

MULTIPOLE MAGNET FOR HOLDING ITEMS TO CLOTHING

CROSS-REFERENCE TO RELATED APPLICATIONS

Not applicable

FEDERALLY SPONSORED RESEARCH

Not applicable

BACKGROUND OF THE INVENTION

1. Technical Field

This application relates to magnetic holders, specifically an improvement to the magnet part of magnetic holding devices used to secure items to clothing.

2. Prior Art

Magnets have long been used in holding devices that attach and hold items to clothing, including buttons, badges, brooches, jewelry, neckties, eyeglasses, flowers, pens, fishing gear, and other items. There are two main parts to such devices. A magnet or magnetic assembly that is placed on the inside of a layer of clothing, and a holding device or assembly that is placed opposite the magnet on the outside layer of clothing that serves to hold an item to the clothing.

The holding device has a base of magnetically attractive material, such as iron or steel or a magnet. Attached to this base, or integral to it, is a part that is configured to hold an item by a clip, a loop, adhesive, or other means. Magnetic devices for attaching items to clothing have been in use for many years. U.S. Pat. No. 2,693,654 by Clark was issued in 1954 and discloses the use of a magnetic holder for insignia without perforating the cloth. Magnets have been used to attach items to clothing for many years.

In the general use of these holders, the holding device is positioned on the outside of a layer of clothing, and the magnet part is placed opposite the holding device on the other side of the clothing. The magnet may be a single magnet, it may be mounted in a base, or may be a group of magnets, such as those found in name badges.

The attraction between the magnet and magnetically attractive base of the holding device act in concert to clamp or grip together using magnetic force and thus will hold suitable items to clothing.

It would be beneficial to have a magnet which provides improved holding properties for use in devices that attach items to clothing.

SUMMARY

In magnetic devices used to attach items to clothing, such as eyeglasses, badges, identification, pens and other small useful or decorative things, a magnet part and a holding part with a magnetically attractive component are brought together on opposite sides of an article of clothing, a shirt for example, and the attractive force between the magnet and the holding device cause the item to be supported.

This application discloses the use of a multipole magnet to improve the holding strength of magnetic holding devices used to attach items to clothing, and to provide extended design options for the holding device.

A multipole magnet has multiple magnetic poles on a face, and the magnet circuit provides an improved magnetic grip on magnetically attractive materials. It also has the benefit of more firmly attracting shapes that have perforations and voids, as well as shapes that are not symmetrical. The improved holding characteristics provided by a multipole magnet provides for many novel and useful designs of holding devices used to attach items to clothing. Magnets of this type are also called dualpole, dualpolar, multipolar, quadrapole, and other similar terms. Sometimes a hyphen is included, such as multi-pole.

DETAILED DESCRIPTION

Poles N and S are provided for descriptive purposes in the various figures, and are not readily visible. The magnetization is through the thickness of the magnet, and both planar faces of the magnet are magnetic.

Figure 1:
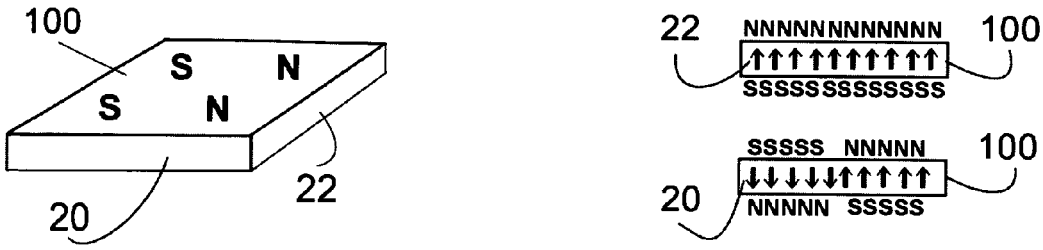
FIG. 1 is a perspective drawing of a first embodiment of the multipole magnet 100 showing two poles on the face, and edges 20, and 22, showing polarity.

FIG. 1 is a perspective view of a first embodiment of the multipole magnet 100. The multipole magnet is generally planar or flat, generally rectangular, proportionally thin, of one solid piece, and has alternating North and South magnetic poles on a face. The opposite face of the multipole magnet 100 has the opposite polarity as the visible face, and is also flat and has the same appearance.

The magnetic poles in FIG. 1, multipole magnet 100, are generally adjacent on the face and alternate between North and South with two poles on the face, with polarity represented by N for North, and S for South.

FIG. 1, edge 20 and edge 22 show the magnetization through the thickness of the magnet and are useful to further describe the multipole magnet when provided to a manufacturer.

FIG. 1 is useful for the specification of manufacture of the multipole magnet 100 in order to describe the polarization pattern of this embodiment. To enable purchase by those skilled in the art of holders, FIG. 1 is provided to the manufacturer describing the desired magnetic pattern for the multipole magnet along with composition, coatings, dimensions, and strength.

The composition of the first embodiment of a multipole magnet 100 is a solid magnet made of NdFeB, also referred to as NIB, or Neo, or Neodymium Iron Boron, or more generally, rare earth magnets. Rare earth magnets are also available made of other materials including samarium cobalt and other compositions, including toughened rare earth materials, and high temperature materials. The manufacture of the first embodiment is described as sintered.

The surface coating of the first embodiment of the multipole magnet 100 is nickel plating. Other plating options are gold, silver, and many other metals and treatments. The surface coating can also be a polymer such as epoxy, or other polymers. The multipole magnet can also be embedded in plastic or metal. Many options are available, and one versed in the art of magnetic holders will immediately recognize the possible options for using the multipole magnet claimed.

The dimensions of the first embodiment of the multipole magnet 100 are approximately 15 mm square, and 4 mm thick. Many suitable sizes and shapes are available, and the description of this embodiment does not limit the scope of the claims. Other shapes are circular, cylinder, rounded edge, kidney shaped, hexagonal, perforated discs, rectangular, and oval. The shape of this first embodiment is conveniently square.

The strength of the first embodiment of a multipole magnet 100 is specified with a code such as N38 or N42 or N45. Other strengths are available and one can expect that there will be magnet innovations in strength and composition that will provide more options for a multipole magnet used in devices which hold items to clothing. When specifying magnets for manufacture, the strength is specified. For example N42 is used in this embodiment.

Multipole magnets are used in industrial and electrical devices, and are readily available as custom manufactured parts from several sources once the manufacturer is provided with the detailed description and figures. The exact description varies between manufacturers, and a drawing such as FIG. 1 is invaluable.

Figure 2:
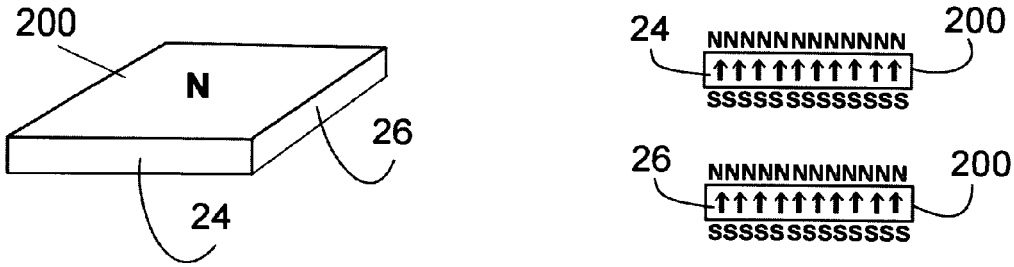
FIG. 2 is a perspective drawing of a common magnet 200 with a pole on the face, and edges 24, and 26, showing polarity.

FIG. 2 is a drawing of a common magnet 200, with a pole on each planar surface. Common magnets are also available with the same rare earth composition as the multipole magnet. Edges 24 and 26 are the same, as are the other two edges of the common magnet. The common magnet 200 does not have the same flux pattern as a multipole magnet, and does not provide the same benefits for devices that hold items to clothing.

Figure 3:
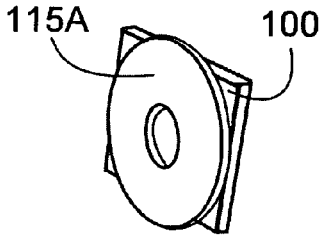
FIG. 3 is perspective view of a multipole magnet 100 in proximity to a magnetically attractive base 115A, represented by a washer.
Figure 4:
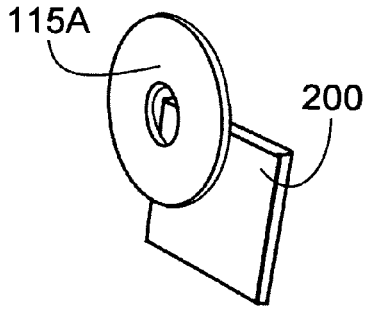
FIG. 4 is perspective view of a common magnet 200 in proximity to a magnetically attractive base 115A, represented by a washer.

How it Works—FIGS. 3-4

FIG. 3 is a perspective view of the multipole magnet 100 and a ferrous metal washer 115A representing the base of a holding member or device. Magnetic holding devices have a base of magnetically attractive material, and the washer 115A is a readily available component.

Washer 115A, is strongly attracted to the center of multipole magnet 100 due to the magnetic circuit produced by having more than one pole on the face, the washer 115A attaches to the central part of the magnet face. When used to hold items to clothing, this attraction provides a much improved magnetic attachment, and allows for many novel designs of holding devices, even those with unusual shapes and voids.

FIG. 3 washer 115A can be pushed off center of multipole magnet 100, but the attractive nature of the magnet pattern resists. It is at rest in the center of the face of the multipole magnet.

FIG. 4 is a perspective view of the common magnet 200 and a ferrous metal washer 115A representing the base of a holding device. Magnetic holding devices have a base of magnetically attractive material, and the washer 115A is a readily available component.

The FIG. 4 washer 115A is strongly attracted to the outer part of the common magnet 200 due to the magnetic circuit produced by having one pole on the face, the washer 115A is strongly attracted the outer edge part of the magnet. When used to hold items to clothing, this limited attraction provides magnetic attachment, but is not as secure as FIG. 3 with a multipole magnet 100, and does not provide a secure attachment to many shapes of holding member bases.

The FIG. 4 washer 115A can be pushed towards the center, but the nature of the magnet pattern in a common magnet 200 gently resists, and the washer 115A is at rest towards the outer edge of the common magnet. This principal is commonly seen in various holding devices used to attach items to clothing, and requires either additional magnets, larger ferrous parts in the base of the holder, or other added parts.

For those skilled in the art of holding devices, an experiment with a small steel ball bearing shows the distinct differences between multipole magnets and common magnets, and the ball bearing will hop to the edge of a common magnet, and center on a multipole magnet. This effect is not illustrated, as ball bearings are not generally used as the base for a holding device but for those skilled in the art of holders, it serves as an easy test of the characteristics of a magnet.

The magnetic flux nature of a single multipole magnet brings advantages to holding devices and to those skilled in making holding devices that are used on clothing.

Holder Bases

Figure 5:
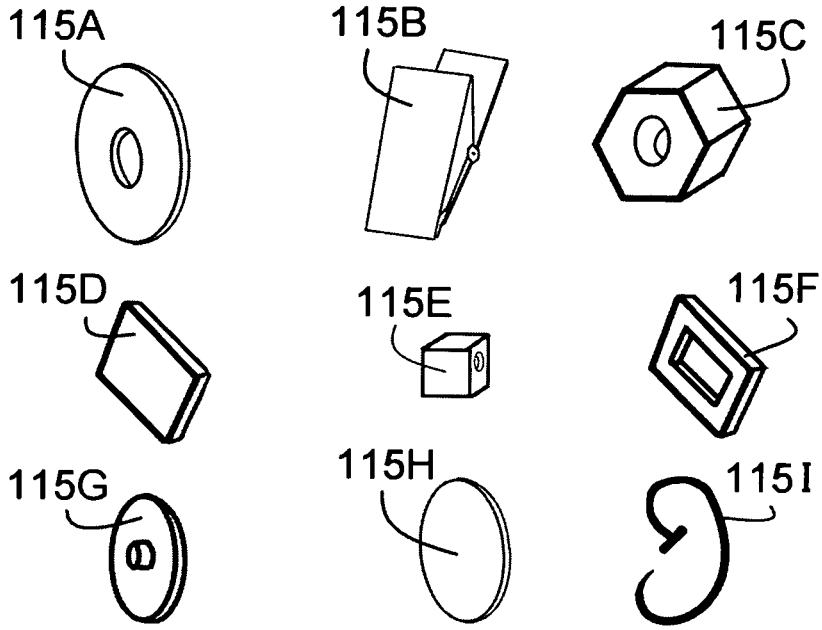
FIG. 5 is a group of magnetically attractive bases of types incorporated into holding devices of many types. A ferrous washer 115A, a ferrous badge clip 115B, a ferrous nut 115C, a ferrous flat block 115D, a ferrous cube with hole 115E, a ferrous flat block with center void 115F, a ferrous tack 115G, a ferrous disk 115H, and a ferrous nail 115I.

FIG. 5 presents examples of common magnetically attractive base components for holding devices. These are strongly attracted to the center of the multipole magnet 100 and can be integrated into holding devices used to attach items to clothing.

FIG. 5 ferrous washer 115A is a readily available steel or iron washer, and is easy to integrate into a holding device by casting, glue, welding, or many other means.

FIG. 5 ferrous badge clip 115B is a readily available steel clip, and is common on badges used for identification or affiliation. It is attracted to the multipole magnet 100 with no added parts, and will hold a conference badge or identification.

FIG. 5 ferrous nut 115C is a readily available steel nut, provides a very secure attachment to the multipole magnet 100. Nut 115C integrated with a holding device will support heavier items. Testing with a 15 mm square by 4 mm thick N42 multipole magnet, and common nut with a 6 mm outer diameter will support over 1 kilo of weight on a thin fabric shirt. The benefits of such holding power are clearly understood by those who are skilled in the design and manufacture of holding devices.

FIG. 5 ferrous block 115D is a readily available steel block. It provides a very secure attachment to the multipole magnet 100. Block 115D integrated with a holding device will support heavier items depending upon the dimensions and thickness of the block.

FIG. 5 perforated ferrous block 115E is a readily available perforated steel block. It provides a very secure attachment to the multipole magnet 100. Block 115E integrated with a holding device or along with a ring or loop will support heavier items depending upon the dimensions and thickness of the block.

FIG. 5 skeletonized ferrous block 115F is a readily available steel block. It provides a very secure attachment to the multipole magnet 100. Block 115F integrated with a holding device will support heavier items depending upon the dimensions and thickness of the block.

FIG. 5 ferrous button 115G is a readily available steel tack button. It provides a very secure attachment to the multipole magnet 100. Button 115F integrated with a holding device provides many design options for one skilled in making holders that attach to clothing.

FIG. 5 ferrous disc 115H is a readily available steel disc. It provides a very secure attachment to the multipole magnet 100. Disc 115H integrated with a holding device will support heavier items depending upon the dimensions and thickness of the disc. It is commonly found as the base of many holding devices, including those that use a magnet attached to the disk for use on the outside of an article of clothing.

FIG. 5 ferrous nail 115I represents a minimalist holder of small items. The ferrous nail 115I is attractive to the multipole magnet 100, and serves to hang personal articles from clothing. One skilled in metalwork will readily appreciate the vast number of configurations possible for holders by using lengths of ferrous materials.

EXAMPLE

Figure 6:
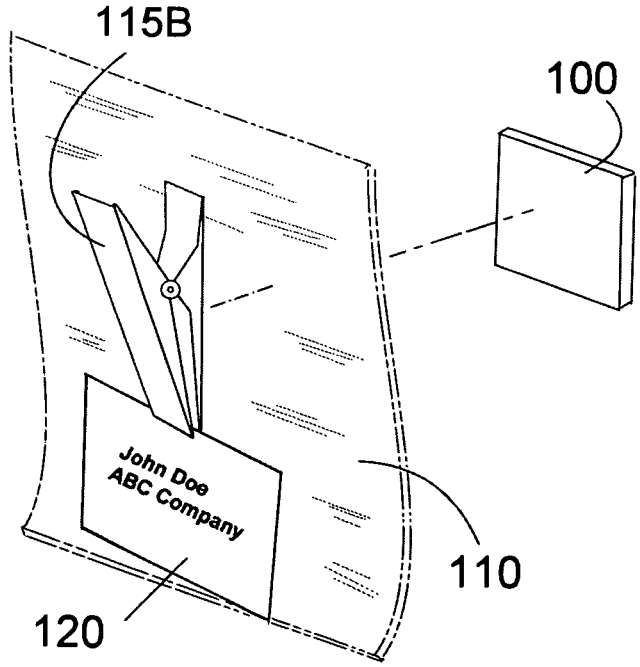
FIG. 6 is a perspective view of the ferrous badge clip 115B representing a holding device, the multipole magnet 100, an article of clothing 110 in between, and the badge clip 115B supporting a fictional name tag 120.

FIG. 6 shows a ferrous badge clip 115B, a layer of clothing 110, and a multipole magnet 100. The clip 115B supports name badge 120 with a fictional name and company.

Such a combination is made possible by the attractive force the multipole magnet exerts on the ferrous clip 115B. It securely fastens the badge to the wearer's clothing and is very convenient. The alternative attachment methods found with such clips involve a lanyard about the neck, or finding a suitable edge to attach the clip, many times rendering the name tag in an awkward position. Clearly this use of a multipole magnet 100 in combination with a badge clip 115B is beneficial. The badge clip 115B is attracted to a common magnet 200, but possibly not with sufficient certainty when a layer of clothing is between magnet and clip. The combination of ferrous clip 115B and multipole magnet 100 provide a confident support mechanism for many types of lightweight badges and identification.

The badge clip 115B represents an example of the many ways that holders are used or can be used to attach items to clothing. Many other holding devices of various configurations can be effectively deployed using the multipole magnet 100.

One skilled in the art of holders will immediately recognize the design benefits to holder configuration brought to bear by the use of multipole magnet 100.

Other Embodiments

Multipole magnets are manufactured for use in electrical and mechanical devices, and are available in many shapes and magnetic configurations. Described in FIGS. 7-12 are some of the most common. The claims of this application should guide the reader regarding the scope of this application.

The use of N for North and S for South, along with the thin lines separating the poles are for descriptive purposes only, and unless manufactured with such indicators, are not visible on the magnet. The magnetization is through the thickness of the magnet, and the other side of the magnet is visually the same, and is opposite magnetically.

Figure 7:
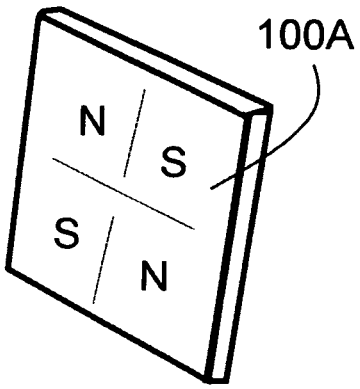
FIG. 7 is a rectangular multipole magnet 100A with four poles on the face.

FIG. 7 is a perspective view of a multipole magnet 100A with a pattern of four poles on each face.

Figure 8:
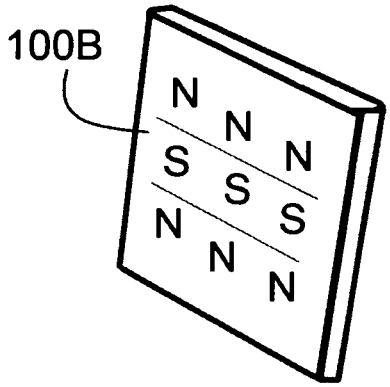
FIG. 8 is a rectangular multipole magnet 100B with three poles on the face.

FIG. 8 is a perspective view of a multipole magnet 100B with a pattern of three poles on each face.

Figure 9:
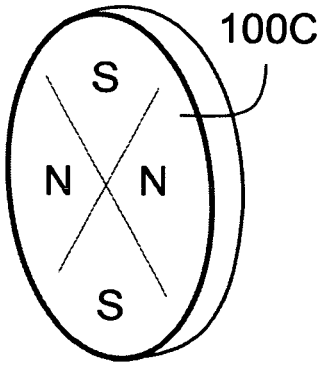
FIG. 9 is a disk shaped multipole magnet 100C with four poles on the face.

FIG. 9 is a perspective view of a disc shaped multipole magnet 100C with a pattern of four poles on each face.

Figure 10:
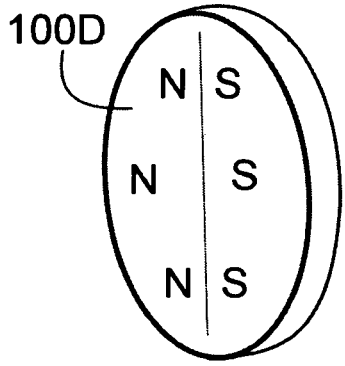
FIG. 10 is a disk shaped multipole magnet 100D with two poles on the face.

FIG. 10 is a perspective view of a disc shaped multipole magnet 100D with a pattern of two poles on each face.

Figure 11:
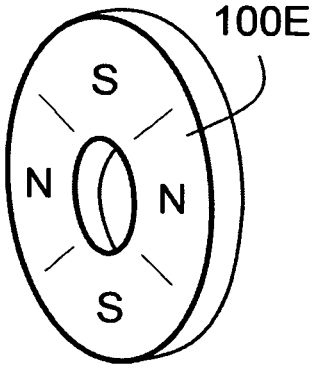
FIG. 11 is a cylinder shaped multipole magnet 100E with four poles on the face.

FIG. 11 is a perspective view of a cylinder shaped multipole magnet 100E with a pattern of four poles on each face.

Figure 12:
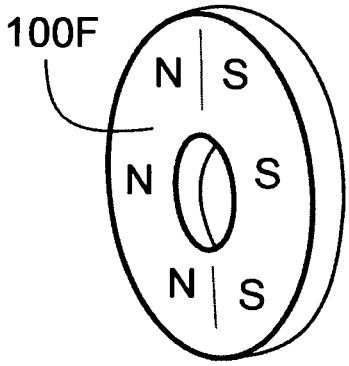
FIG. 12 is a cylinder shaped multipole magnet 100F with two poles on the face.

FIG. 12 is a perspective view of a cylinder shaped multipole magnet 100F with a pattern of two poles on each face.

Many alternatives can be imagined for multipole magnets, and many are in use in various electrical or mechanical devices, some with many more poles than those described here. The functional benefits of a plurality of poles on the face of a multipole magnet are substantial, and bring new holding power to magnetic holders that incorporate a multipole magnet, and many new design options for holders, at reduced manufacturing cost.

CONCLUSIONS RAMIFICATIONS AND SCOPE

The reader will see that the disclosed embodiment of a multipole magnet for use in devices that hold items to clothing enables many new types of holders used to attach items to clothing, and those skilled in the art of such holders will appreciate the expanded design options for magnetic holders to clothing. Reducing the number of parts, reducing the weight, and improved holding power can all be achieved with the use of the multipole magnet in a holding device.

Those skilled in the art of magnets will recognize that many different multipole magnets are available for manufacture and will have suitable properties for use in holders that attach or suspend items to clothing.

While my above description contains many specificities, these should not be construed as limitations on the scope, but rather as exemplifications of a preferred embodiment thereof. Many variations of multipole magnets are possible, including size, shape, strength, composition, coatings, and magnetic pattern.

Accordingly, the scope should be determined not by the embodiment(s) illustrated, but by the appended claims and their legal equivalents.

The invention claimed is:

1. In a magnetic apparatus for holding at least one accessory to an article of clothing, comprising: a magnet member and a holding member having a magnetically attractive base thereon, the members are placed opposite one another with the article of clothing positioned therebetween causing the operative combination of the magnet member and the holding member to attract and provide a means to hold the at least one accessory to the article of clothing; the improvement comprises the magnet member being further defined as a single piece multipole magnet, said multipole magnet having a continuous planar face, and said face having at least two magnetic poles of opposite polarity.

2. The improved magnetic apparatus in claim 1, wherein said multipole magnet is magnetized through its thickness.

3. The improved magnetic apparatus in claim 1, wherein said multipole magnet is composed of rare earth materials.

4. The improved magnetic apparatus in claim 1, wherein said multipole magnet is composed of toughened rare earth materials.

* * * * *